US011815239B2

(12) United States Patent
Imamura et al.

(10) Patent No.: US 11,815,239 B2
(45) Date of Patent: Nov. 14, 2023

(54) VEHICLE LIGHT

(71) Applicant: Ichikoh Industries, Ltd., Isehara (JP)

(72) Inventors: Hiroya Imamura, Isehara (JP); Takashi Muto, Isehara (JP); Eiji Suzuki, Isehara (JP)

(73) Assignee: Ichikoh Industries, Ltd., Isehara (JP)

( * ) Notice: Subject to any disclaimer, the term of this patent is extended or adjusted under 35 U.S.C. 154(b) by 57 days.

(21) Appl. No.: 17/613,119

(22) PCT Filed: May 20, 2020

(86) PCT No.: PCT/JP2020/020003

§ 371 (c)(1),
(2) Date: Nov. 22, 2021

(87) PCT Pub. No.: WO2020/241424

PCT Pub. Date: Dec. 3, 2020

(65) Prior Publication Data

US 2022/0205607 A1 Jun. 30, 2022

(30) Foreign Application Priority Data

May 24, 2019 (JP) ..... 2019-097517

(51) Int. Cl.

| | |
|---|---|
| ***F21S 41/265*** | (2018.01) |
| ***F21S 41/255*** | (2018.01) |
| ***F21S 41/365*** | (2018.01) |
| ***F21S 41/148*** | (2018.01) |
| *F21Y 115/10* | (2016.01) |
| *F21W 102/13* | (2018.01) |

(52) U.S. Cl.

CPC ..... *F21S 41/255* (2018.01); *F21S 41/148* (2018.01); *F21S 41/265* (2018.01); *F21S 41/365* (2018.01);

(Continued)

(58) Field of Classification Search

CPC ..... F21S 41/365; F21S 41/321; F21S 41/36; F21S 41/43; F21S 41/148; F21S 41/255;

(Continued)

(56) References Cited

U.S. PATENT DOCUMENTS 11,168,858 B2 * 11/2021 Ohashi ..... F21S 41/24
2012/0262935 A1 10/2012 Yamamoto (Continued)

FOREIGN PATENT DOCUMENTS

CN 106813176 A * 6/2017
CN 108644739 A * 10/2018 ..... F21V 5/04

(Continued)

OTHER PUBLICATIONS

Search English translation of CN-108644739-A (Year: 2018).*

(Continued)

*Primary Examiner* — Omar Rojas Cadima
(74) *Attorney, Agent, or Firm* — Oblon, McClelland, Maier & Neustadt, L.L.P.

(57) ABSTRACT

Provided is a vehicular lamp that forms a light distribution pattern for traveling having a lower end portion overlapping an upper end portion of a light distribution pattern for passing and is downsized with a simple configuration. The vehicular lamp includes a projection lens that projects light emitted from a first light source to form the light distribution pattern for passing and projects light emitted from a second light source to form the light distribution pattern for traveling. A lower lens part and an upper lens part are set in the projection lens about a lens axis as a center, a lower focus is set on the lens axis in the lower lens part, and an upper focus shorter in focal length than the lower focus is set on the lens axis in the upper lens part.

7 Claims, 8 Drawing Sheets

(52) U.S. Cl.
CPC ..... *F21W 2102/13* (2018.01); *F21Y 2115/10* (2016.08)

(58) Field of Classification Search
CPC ... F21S 41/265; F21S 41/275; F21Y 2115/10; F21W 2102/155; F21W 2102/13; F21W 2102/00; F21W 2107/10
See application file for complete search history.

(56) References Cited

U.S. PATENT DOCUMENTS

| | | | | |
|---|---|---|---|---|
| 2016/0230948 | A1* | 8/2016 | Kratochvil | F21S 41/43 |
| 2017/0158113 | A1* | 6/2017 | Kanayama | F21S 41/255 |
| 2017/0276310 | A1* | 9/2017 | Nakazawa | F21S 41/285 |

FOREIGN PATENT DOCUMENTS

| | | | |
|---|---|---|---|
| EP | 3 805 634 | A1 | 4/2021 |
| JP | 6-20505 | A | 1/1994 |
| JP | 2007-109493 | A | 4/2007 |
| JP | 2012-226860 | A | 11/2012 |

OTHER PUBLICATIONS

Search English translation of CN-106813176-A (Year: 2017).*
International Search Report dated Jul. 14, 2020 in PCT/JP2020/020003 filed on May 20, 2020 (2 pages).
Extended European Search Report dated May 10, 2023 in European Patent Application No. 20815055.7, 7 pages.

* cited by examiner

VEHICLE LIGHT

TECHNICAL FIELD

The present disclosure relates to a vehicular lamp.

BACKGROUND ART

A conventional vehicular lamp emits, through a projection lens, light from a first light source so as to form a light distribution pattern for passing and emits, through the projection lens, light from a second light source so as to form a light distribution pattern for traveling.

As such a vehicular lamp, a vehicular lamp capable of forming the light distribution pattern for traveling so that part of the light distribution pattern for traveling may cross over a cutoff line in the light distribution pattern for passing is conceived (see PTL1, for instance). In this vehicular lamp, an additional projection lens is so provided as to surround a projection lens, and a focus of the projection lens, a focus of an upper lens part of the additional projection lens, and a focus of a lower lens part of the additional projection lens are set in various positions. This vehicular lamp uses reflectors set correspondingly to the respective focuses to cause light from a first light source and light from a second light source to reflect from the reflectors and pass through the respective focuses, so as to form the light distribution pattern for passing and the light distribution pattern for traveling so that the light distribution pattern for traveling may cross over the cutoff line of the light distribution pattern for passing.

CITATION LIST

Patent Literature

PTL 1: JP 2007-109493 A

SUMMARY OF THE INVENTION

Problems to be Solved by the Invention

In the vehicular lamp as above, however, in order to form the light distribution pattern for traveling, which has a lower end portion overlapping an upper end portion of the light distribution pattern for passing, it is necessary to provide the additional projection lens around the projection lens while imparting different curved faces to the projection lens as well as the upper lens part and the lower lens part of the additional projection lens. Consequently, the above vehicular lamp includes a complicated and large-sized lens. In the above vehicular lamp, a space needs to be secured for optical paths of light passing through the respective focuses set in various positions, leading to general enlargement.

The present disclosure has been made under such circumstances and is aimed at providing a vehicular lamp that forms a light distribution pattern for traveling having a lower end portion overlapping an upper end portion of a light distribution pattern for passing and is downsized with a simple configuration.

Means for Solving the Problem

A vehicular lamp of the present disclosure includes a projection lens projecting light emitted from a first light source to form a light distribution pattern for passing and project light emitted from a second light source to form a light distribution pattern for traveling, a lower lens part and an upper lens part are set in the projection lens about a lens axis as a center, a lower focus is set on the lens axis in the lower lens part, and an upper focus shorter in focal length than the lower focus is set on the lens axis in the upper lens part.

Effect of the Invention

According to the vehicular lamp of the present disclosure, it is possible to form a light distribution pattern for traveling having a lower end portion overlapping an upper end portion of a light distribution pattern for passing and, at the same time, achieve the downsizing with a simple configuration.

MODE FOR CARRYING OUT THE INVENTION

Figure 1:
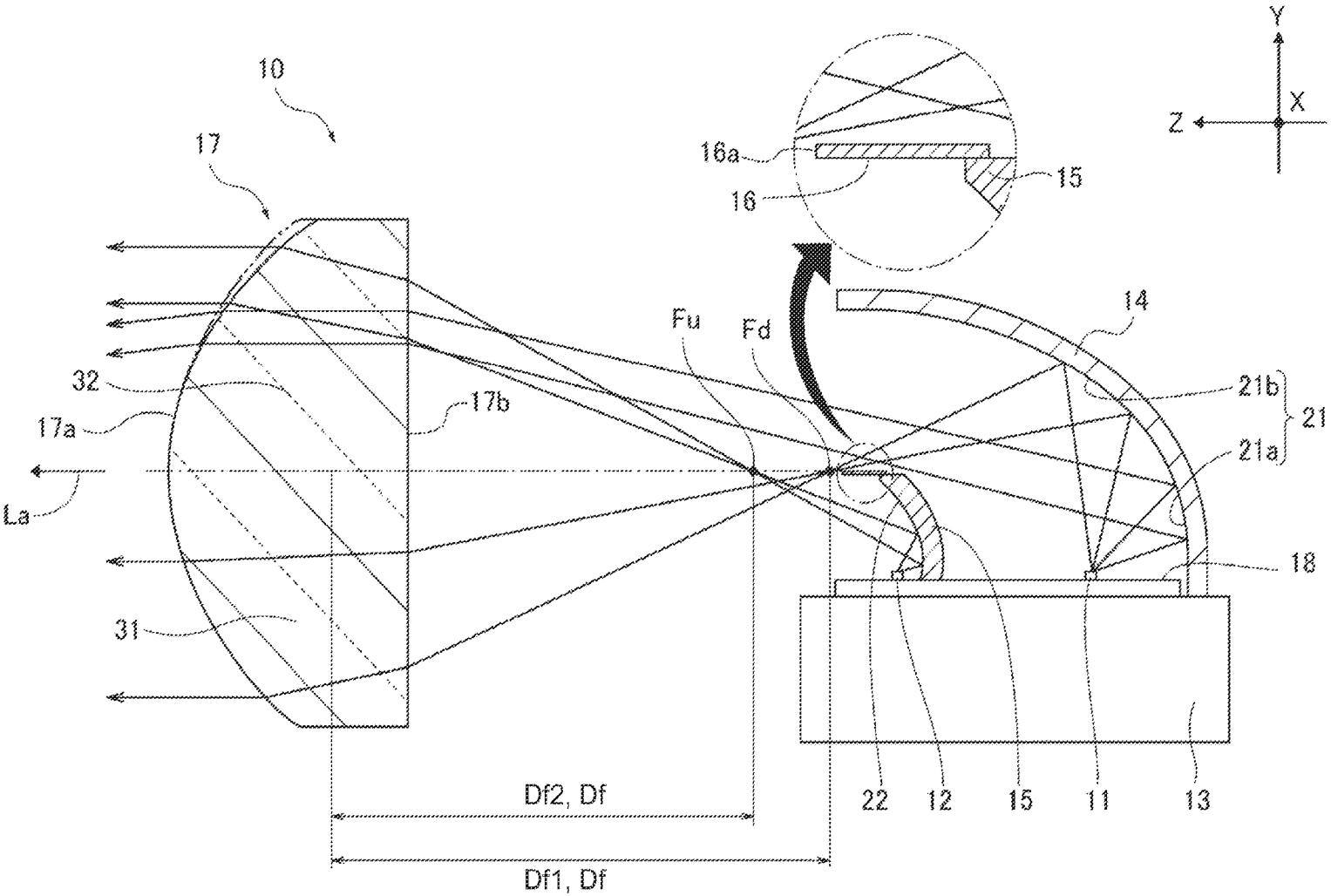
FIG. 1 is a diagram illustrating a vehicular lamp as Example 1 of a vehicular lamp according to the present disclosure.

In the following, examples of a vehicular lamp according to the present disclosure are described with reference to the drawings.

Example 1

Using FIGS. 1 through 7, the vehicular lamp 10 of Example 1 as an embodiment of the vehicular lamp according to the present disclosure is described. The vehicular lamp 10 of Example 1 is used as a lamp for a vehicle such as an automobile, and used for a headlamp or a fog lamp, for instance. The vehicular lamp 10 is arranged on both the right and left sides of a front portion of a vehicle and provided, through an optical axis adjustment mechanism in vertical direction or an optical axis adjustment mechanism in lateral direction, in a lamp chamber formed by covering an opened front end of a lamp housing with an outer lens. In the following description, with respect to the vehicular lamp 10, the direction of travel of a vehicle traveling straightforward, namely, the direction, in which light is emitted, is referred to as an optical axis direction (represented by Z in the drawings), the up and down direction in a state of being installed in a vehicle is referred to as a vertical direction (represented by Y in the drawings), and the direction, which is orthogonal to the optical axis direction and the vertical direction, is referred to as a width direction (represented by X in the drawings).

As illustrated in FIG. 1, the vehicular lamp 10 includes a first light source 11, a second light source 12, a heat radiating member 13, a first reflector 14, a second reflector 15, a shade 16, and a projection lens 17, and constitutes a headlight unit of a projector type.

The first light source 11 is constituted of a light emitting element such as an LED (light emitting diode) and implemented on a board 18. The board 18 is fixed to an upper face 13*a* of the heat radiating member 13. The first light source 11 has an optical axis of light emission (optical axis direction) substantially coincident with the vertical direction, and is appropriately turned on by the feed of power from a lighting control circuit.

The second light source 12 is constituted of a light emitting element such as an LED and implemented on the board 18 ahead of the first light source 11 in the optical axis direction. Consequently, the second light source 12 is in the same plane with the first light source 11. The second light source 12 has an optical axis of light emission (optical axis direction) substantially coincident with the vertical direction, and is appropriately turned on by the feed of power from the lighting control circuit. The second light source 12 in Example 1 is constituted of a plurality of light source parts 12*a* (one light source part nearest to a viewer being only illustrated in FIG. 1) aligned on the board 18 in the width direction. The light source parts 12*a* are each constituted of a light emitting element, and are appropriately turned on in a simultaneous or individual manner by the feed of power from the lighting control circuit.

The heat radiating member 13 is a heat sink member for releasing heat generated in the first light source 11 and the second light source 12 outside, and is formed of die-cast aluminum or a resin having heat conductivity and appropriately provided with a plurality of heat radiating fins, with an upper face 13*a* being made to be a flat face orthogonal to the vertical direction. On the upper face 13*a* of such heat radiating member 13, the board 18 is provided, and the first reflector 14 and the second reflector 15 are provided on the upper face 13*a* correspondingly to the first light source 11 and the second light source 12 on the board 18, respectively. The upper face 13*a* of the heat radiating member 13 in Example 1 is provided below a lens axis La of the projection lens 17 in the vertical direction.

The first reflector 14 covers the first light source 11 and the second reflector 15 and has a first reflective face 21 opposite to the first light source 11. The first reflective face 21 reflects light emitted from the first light source 11 toward the projection lens 17. The first reflective face 21 is formed by adhering a reflective material, such as aluminum and silver, onto an inner face of the first reflector 14 opposite to the first light source 11 by vapor deposition, application or the like. The first reflective face 21 in Example 1 has a lower reflective face part 21*a* on a base side of the first reflector 14 and an upper reflective face part 21*b* continuously extending from the lower reflective face part 21*a* upward. The lower reflective face part 21*a* is provided below an upper edge of the second reflector 15 (the lens axis La) in the vertical direction, is assumed as a free-form surface based on an ellipse having a focus at the first light source 11, and reflects the light emitted from the first light source 11 toward an upper lens part 32 set in an upper portion of the projection lens 17. The upper reflective face part 21*b* is assumed as a free-form surface based on an ellipse having a first focus at the first light source 11 and a second focus in the vicinity of a front edge portion 16*a* of the shade 16 (a lower focus Fd of a lower lens part 31), and reflects the light emitted from the first light source 11 toward the lower focus Fd.

The second reflector 15 is provided ahead of the first light source 11 but behind two focuses (the lower focus Fd and an upper focus Fu) of the projection lens 17 in the optical axis direction inside the first reflective face 21 and below the lens axis La in the vertical direction. The second reflector 15 covers the second light source 12 and has a second reflective face 22 opposite to the second light source 12. The second reflective face 22 reflects light emitted from the second light source 12 toward the upper lens part 32 set in the upper portion of the projection lens 17. The second reflective face 22 is formed by adhering a reflective material, such as aluminum and silver, onto an inner face of the second reflector 15 opposite to the second light source 12 by vapor deposition, application or the like. The second reflective face 22 is assumed as a free-form surface based on an ellipse having a first focus at the second light source 12 and a second focus in the vicinity of the upper focus Fu of the upper lens part 32, which is set on the lens axis La, and reflects the light emitted from the second light source 12 toward the upper focus Fu. The second reflector 15 is not limited to the configuration in Example 1 but may be provided ahead of the first reflective face 21.

Figure 4:
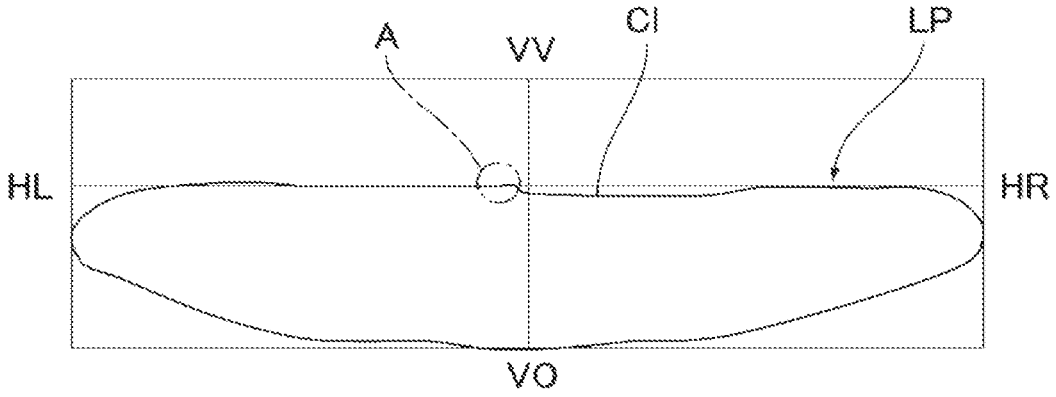
FIG. 4 is a diagram illustrating a light distribution pattern for passing.

The shade 16 blocks part of the light emitted from the first light source 11, so as to form a cutoff line Cl of a light distribution pattern LP for passing (see FIG. 4 and so forth). The shade 16 is in the form of a plate extending in the width direction and has the shape, in which two horizontal edges at different heights are joined by a tilted edge. The shade 16 is arranged so that the front edge portion 16*a* may be located at or near the lower focus Fd of the projection lens 17. The shade 16 forms the cutoff line Cl, which is constituted of two horizontal lines joined by a tilted line, at an upper edge of the light distribution pattern LP for passing by blocking, with the front edge portion 16*a*, part of the light as emitted from the first light source 11 and reflected by the first reflective face 21 of the first reflector 14. The shade 16 blocks light at a horizontal plane including the lens axis La, that is to say, prevents light from passing through the horizontal plane in the vertical direction at least between the lower focus Fd and the second reflector 15 (a front end thereof).

The projection lens 17 projects, toward the front of a vehicle, the light as emitted from the first light source 11 and reflected by the first reflector 14 (the first reflective face 21 thereof), so as to form the light distribution pattern LP for passing (see FIG. 4 and so forth). In addition, the projection lens 17 projects, toward the front of the vehicle, the light as emitted from the second light source 12 and reflected by the second reflector 15 (the second reflective face 22 thereof), so as to form a light distribution pattern HP for traveling (see FIG. 5 and so forth). The projection lens 17 is fitted to the heat radiating member 13 through a lens holder in the state of being positioned with respect to the first light source 11, the second light source 12, the first reflector 14, the second reflector 15, and the shade 16.

The projection lens 17 is in the form of a convex lens that is circular as viewed from the front in the optical axis direction, and it is assumed in Example 1 that a light exit face 17*a* is a convex face and a light entrance face 17*b* is a flat face. The projection lens 17 is not limited to the configuration in Example 1, and the light exit face 17*a* may be a flat face or a concave face and the light entrance face 17*b* may be a convex face or a concave face as long as the projection lens 17 is a convex lens as a whole. The projection lens 17 has the lens axis La, which extends in the optical axis direction. The lens axis La is an optical axis passing through the position in the projection lens 17, where the thickness in the optical axis direction is largest, and the direction, in which the lens axis La extends, is made parallel to (coincident with) the optical axis direction.

Next using FIGS. 1 through 6, a detailed configuration of the projection lens 17 is described. On a vertical axis in FIG. 3, a focal length Df as a distance from a principal point to a focus on a back side in the optical axis direction in the projection lens 17 is shown. Assuming a portion under the lens axis La of a vertical plane including the lens axis La as a reference plane Br, an angle θ in a rotational direction about the lens axis La as a center of rotation (zero degrees at the reference plane Br), with a counterclockwise side being a positive side and a clockwise side being a negative side, is shown on a horizontal axis in FIG. 3.

Figure 2:
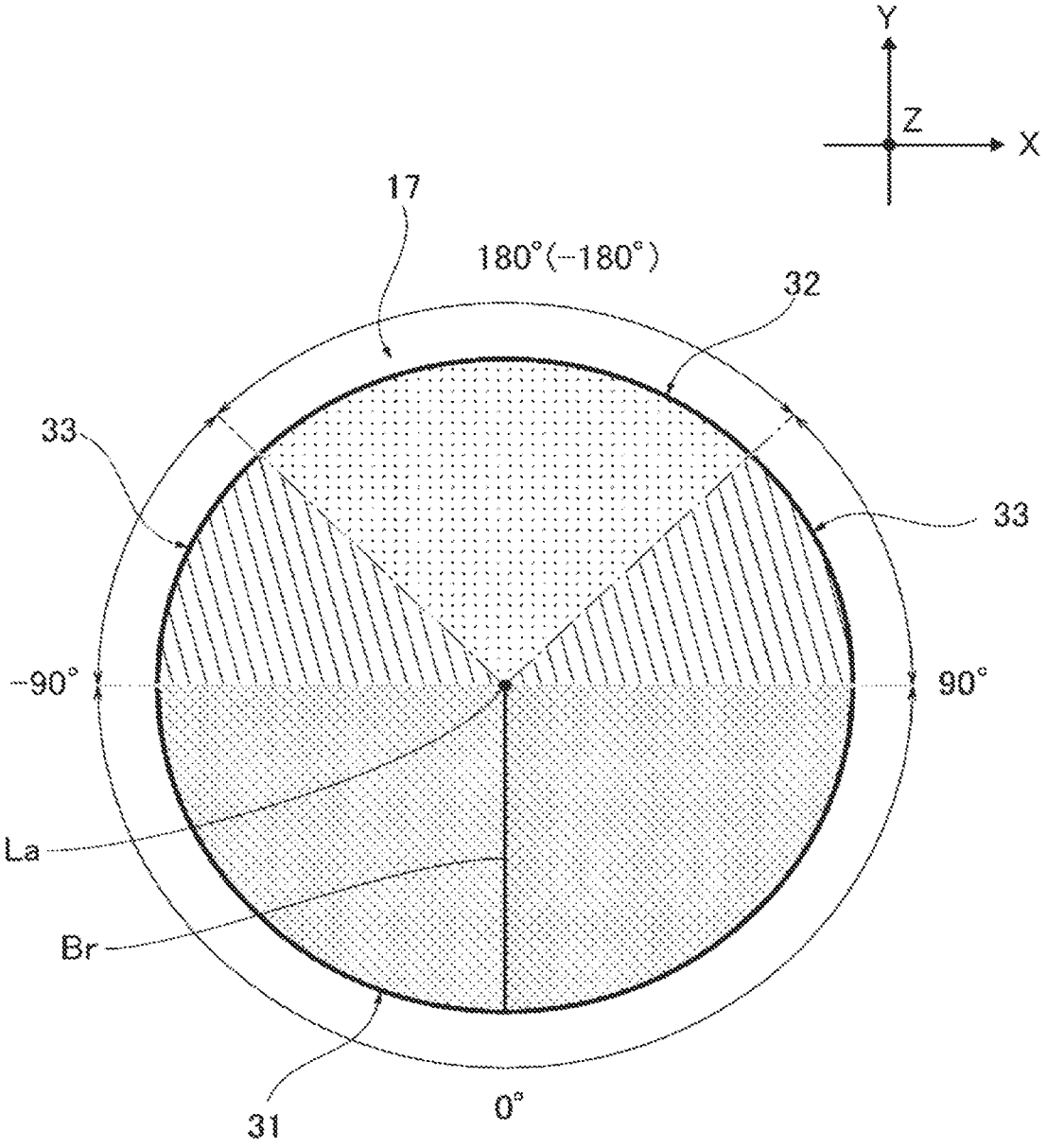
FIG. 2 is a diagram for explaining a rotational direction about a lens axis in a projection lens, as viewed from a front in an optical axis direction.

As illustrated in FIG. 2, the projection lens 17 is divided in the rotational direction about the lens axis La as a center of rotation so as to set the lower lens part 31 located on a lower side, the upper lens part 32 located on an upper side, and two gradual change lens parts 33 joining the lower lens part 31 and the upper lens part 32. The projection lens 17 is plane-symmetrically formed with respect to the vertical plane including the lens axis La, with the lens parts (31, 32, and 33) each having an angular range (the absolute value of the angle θ in FIG. 3) with respect to the reference plane Br (vertical plane) that is made equal on the right and left, and the two gradual change lens parts 33 make a pair in the width direction. The lens parts (31, 32, and 33) are made different from one another in the curvature of the light exit face 17*a* in a cross section extending from the lens axis La in a radial direction, and made different from one another in the focal length Df. In other words, in the projection lens 17, different focal lengths Df are set according to the angular range in the rotational direction about the lens axis La while the lens axis La is shared.

Figure 3:
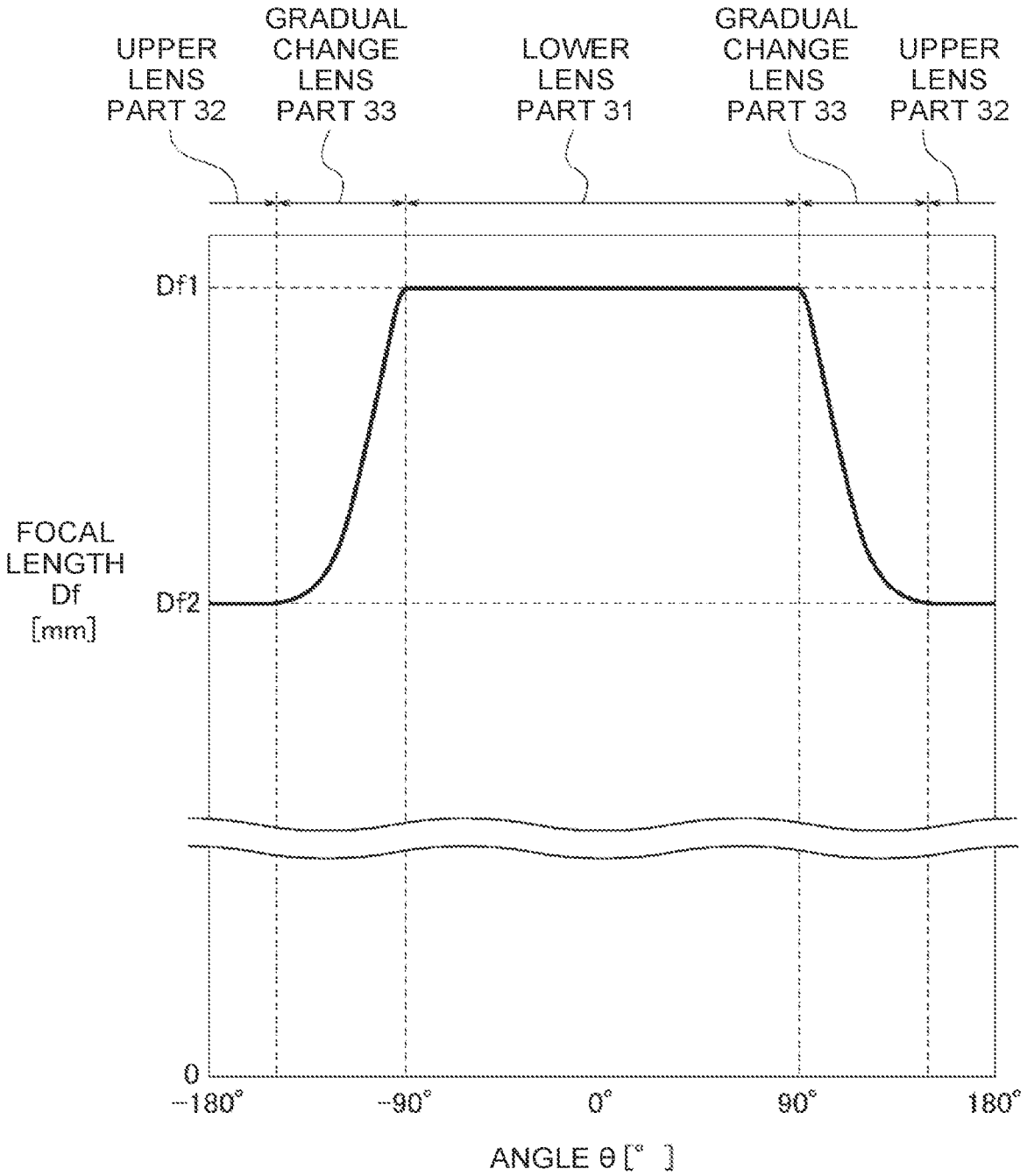
FIG. 3 is a graph illustrating a relationship between focal length and position in the rotational direction in the projection lens, with the focal length being shown on a vertical axis and the position in the rotational direction being shown on a horizontal axis.

The lower lens part 31 forms the light distribution pattern LP for passing (at least part thereof) in FIG. 4 by projecting, toward the front of the vehicle, the light as emitted from the first light source 11 and reflected by the first reflector 14 (the first reflective face 21 thereof). As illustrated in FIGS. 1 and 3, in the lower lens part 31, the lower focus Fd as a focus on the back side in the optical axis direction is set in a position on the lens axis La that gives a focal length Df1, and arranged in the vicinity of the front edge portion 16*a* of the shade 16.

Figure 5:
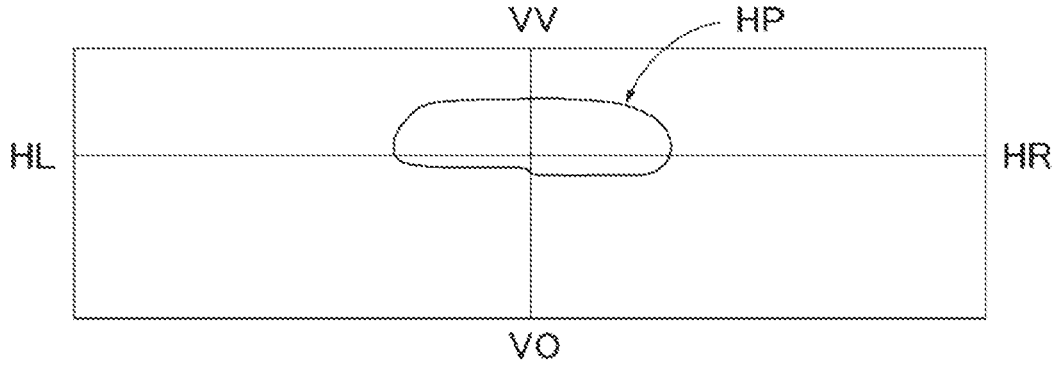
FIG. 5 is a diagram illustrating a light distribution pattern for traveling.

The upper lens part 32 forms the light distribution pattern HP for traveling in FIG. 5 by projecting, toward the front of the vehicle, the light as emitted from the second light source 12 and reflected by the second reflector 15 (the second reflective face 22 thereof). In the upper lens part 32, the upper focus Fu as a focus on the back side in the optical axis direction is set in a position on the lens axis La that gives a focal length Df2. The upper lens part 32 in Example 1 is made to have the focal length Df2, which is shorter than the focal length Df1, by setting the curvature of the light exit face 17*a* to be larger than the curvature of the light exit face 17*a* in the lower lens part 31 (line illustrated above the lens axis La in FIG. 1 with a long-dashed double-dotted line). The upper focus Fu (the focal length Df2) is appropriately set on the basis of the lower focus Fd. It is also possible to set the lower focus Fd on the basis of the upper focus Fu.

Each gradual change lens part 33 joins the lower lens part 31 and the upper lens part 32, which are made different in the focal length Df from each other, and continuously changes (that is to say, makes a so-called gradual change of) the focal length Df from the lower focus Fd on the lower lens part 31 side to the upper focus Fu on the upper lens part 32 side. In other words, each gradual change lens part 33 continuously changes the focal length Df so that the focal length Df may be the focal length Df1 in the angular position about the lens axis La as a center of rotation, where the relevant gradual change lens part 33 is in contact with the lower lens part 31, and the focal length Df2 in the angular position, where the relevant gradual change lens part 33 is in contact with the upper lens part 32 (see FIG. 3). Therefore, each gradual change lens part 33 is so formed as to change the focal length Df according to the angular position and, at the same time, have a focus (point where a parallel light is condensed) on the lens axis La in any angular position.

In the projection lens 17 in Example 1, the lower lens part 31 occupies an angular range from zero degrees to 90 degrees on an absolute value basis, the upper lens part 32 occupies an angular range from 135 degrees to 180 degrees on an absolute value basis, and the two gradual change lens parts 33 each occupy an angular range from 90 degrees to 135 degrees on an absolute value basis. In the projection lens 17, moreover, the focal length Df is of an equal value in angular positions where an angle on the positive side measured counterclockwise from the reference plane Br and an angle on the negative side measured clockwise from the reference plane Br are equal to each other on an absolute value basis, and as such has a value between the focal length Df1 and the focal length Df2. The angular ranges of the lower lens part 31, the upper lens part 32, and the two gradual change lens parts 33 are not limited to the configuration in Example 1 but may be set as appropriate or made different between the right and the left.

Next, the lighting of the vehicular lamp 10 is described. The vehicular lamp 10 is provided in the lamp chamber, and an external connector is connected to the board 18 through a connector joint. In the vehicular lamp 10, the first light source 11 and the second light source 12 implemented on the board 18 are appropriately turned on and off by the feed of power from the lighting control circuit to the first light source 11 and the second light source 12 through the external connector and the connector joint.

As illustrated in FIG. 1, in the vehicular lamp 10, light from the first light source 11 as turned on is reflected by the upper reflective face part 21*b* of the first reflective face 21 of the first reflector 14 so as to cause the light to travel into the vicinity of the lower focus Fd of the lower lens part 31 of the projection lens 17, which focus is set on the lens axis La in the vicinity of the front edge portion 16*a* of the shade 16. The light is partially blocked by the front edge portion 16*a* and is given a shape along the front edge portion 16*a*, then travels to the lower lens part 31 and is projected by the lower lens part 31 (the projection lens 17) so as to form the light distribution pattern LP for passing in FIG. 4, which has the cutoff line Cl at the upper edge.

The vehicular lamp 10 includes the shade 16, which is provided at least between the lower focus Fd of the lower lens part 31 and the front end of the second reflector 15, and light is blocked at the horizontal plane including the lens axis La between the lower focus Fd and the front end of the second reflector 15. Consequently, in the vehicular lamp 10, it is possible to cause the light as emitted from the first light source 11 and reflected by the upper reflective face part 21*b* to travel above the front edge portion 16*a* of the shade 16 in a lower focus plane including the lower focus Fd (image plane) and enter the lower lens part 31. As a result, in the vehicular lamp 10, it is possible to prevent the light as reflected by the upper reflective face part 21*b* from being projected into an unwanted position in a region (above a position (horizontal line) of the lens axis La in a projection plane) where the light distribution pattern HP for traveling in FIG. 5 is formed.

In the vehicular lamp 10, the light from the first light source 11 as turned on is reflected by the lower reflective face part 21*a* of the first reflective face 21 of the first reflector 14 so as to cause the light to travel above the shade 16 to the upper lens part 32 of the projection lens 17. The light is projected by the upper lens part 32 (the projection lens 17) so as to irradiate and illuminate an optional position in the light distribution pattern LP for passing in FIG. 4 with the light.

In the vehicular lamp 10, the lower reflective face part 21*a* is provided below the upper edge of the second reflector 15 in the vertical direction, so that it is possible to cause the light as emitted from the first light source 11 and reflected by the lower reflective face part 21*a* to travel above the lens axis La in an upper focus plane including the upper focus Fu (image plane) and enter the upper lens part 32. As a result, in the vehicular lamp 10, it is possible to prevent the light as reflected by the lower reflective face part 21*a* from being projected into an unwanted position in a region where the light distribution pattern HP for traveling is formed. Thus in the vehicular lamp 10, the light distribution pattern LP for passing is appropriately formed.

Figure 6:
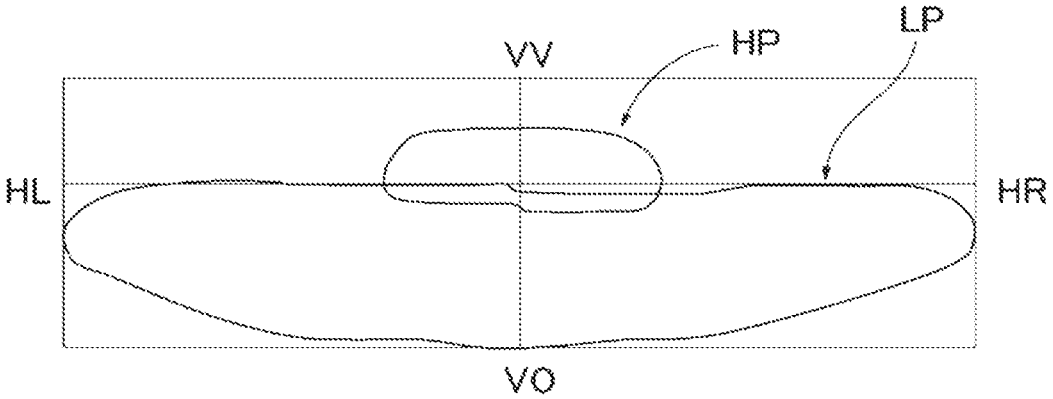
FIG. 6 is a diagram illustrating the light distribution pattern for traveling and the light distribution pattern for passing, which are formed at a time.

In addition, in the vehicular lamp 10, light from the second light source 12 as turned on is reflected by the second reflective face 22 of the second reflector 15 so as to cause the light to travel into the vicinity of the upper focus Fu of the upper lens part 32 of the projection lens 17, which focus is set on the lens axis La. The light travels to the upper lens part 32 and is projected by the upper lens part 32 (the projection lens 17) so as to form the light distribution pattern HP for traveling (see FIG. 5). In the vehicular lamp 10, the upper focus Fu is so set on the lens axis La as to be closer to the projection lens 17 (that is to say, as to be of a shorter focal length Df) than the lower focus Fd set in the vicinity of the front edge portion 16*a* of the shade 16. Consequently, in the vehicular lamp 10, light is not blocked by the shade 16 in the vicinity of the upper focus Fu, so that it is possible to cause the light from the second light source 12 to travel not only below the upper focus Fu in a focal plane including the upper focus Fu (image plane) but above the upper focus Fu in the same focal plane to the upper lens part 32. Thus in the vehicular lamp 10, as illustrated in FIG. 5, it is possible to arrange a lower edge of the light distribution pattern HP for traveling below the position (horizontal line) of the lens axis La in the projection plane even if part of the light from the second light source 12 is blocked by the front edge portion 16*a* of the shade 16 and the lower edge is given a shape along the front edge portion 16*a*. Therefore in the vehicular lamp 10, as illustrated in FIG. 6, the light distribution pattern HP for traveling is formed with the light from the second light source 12 so that a lower end portion of the light distribution pattern HP for traveling may overlap an upper end portion of the light distribution pattern LP for passing.

The vehicular lamp 10 of Example 1 may be an ADB (adaptive driving beam (adaptive headlight)). In that case, if the light source parts 12*a* of the second light source 12 in the vehicular lamp 10 are turned on, light from each light source part 12*a* forms a light distribution portion obtained by dividing the light distribution pattern HP for traveling in the width direction. In the vehicular lamp 10 in that case, a light distribution portion in a specified direction can be extinguished among a plurality of light distribution portions by individually turning on and off the light source parts 12*a*. Thus in the vehicular lamp 10 in that case, a partial extinguishment in an optional direction in the light distribution pattern HP for traveling is allowed by individually turning on and off the light source parts 12*a*.

Therefore, in the vehicular lamp 10, the light distribution pattern LP for passing having the cutoff line Cl is formed as illustrated in FIG. 4 by turning on the first light source 11, so as to achieve the light distribution during the passing (as so-called low beams). Further, in the vehicular lamp 10, the light distribution pattern HP for traveling, which partially overlaps the light distribution pattern LP for passing, is formed as illustrated in FIG. 6 by turning on not only the first light source 11 but the second light source 12, so as to achieve the light distribution during the traveling (as so-called high beams). In the vehicular lamp 10, moreover, it is also possible to turn off a light source part 12*a* located in an optional direction among the light source parts 12*a* of the second light source 12, as described above, so as not to form only a light distribution portion in the corresponding direction and thereby exert a function of the ADB.

Next, operations of the vehicular lamp 10 are described. First of all, description is made on a conventional, general vehicular lamp (hereinafter referred to as a conventional vehicular lamp) for comparison with the vehicular lamp 10. The conventional vehicular lamp is the same in configuration as the vehicular lamp 10 of Example 1 except that a focus on the back side in the optical axis direction of the projection lens 17 is only set at one place corresponding to the lower focus Fd in the vicinity of the front edge portion 16*a* of the shade 16. Therefore, in order to facilitate understanding, the following description is made using the same names and reference signs as the vehicular lamp 10.

Figure 7:
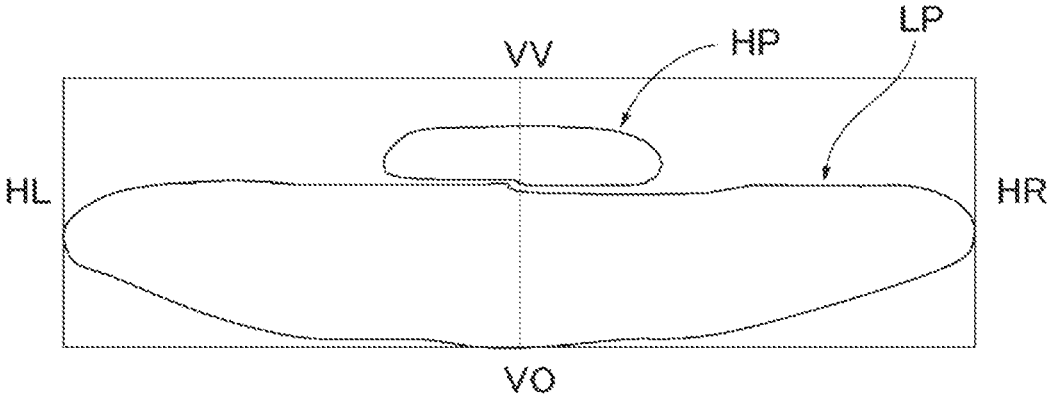
FIG. 7 is a diagram illustrating a light distribution pattern for traveling and a light distribution pattern for passing that are formed at a time by a vehicular lamp of a comparative example.

In the conventional vehicular lamp, light traveling from the first light source 11 via the first reflector 14 and light traveling from the second light source 12 via the second reflector 15 are caused to enter the projection lens 17 via the vicinity of the lower focus Fd. Consequently, in the conventional vehicular lamp, the light distribution pattern LP for passing having the cutoff line Cl at the upper edge is formed by blocking part of the light from the first light source 11 by the shade 16, as is the case with the vehicular lamp 10. In the conventional vehicular lamp, however, it is not possible to cause the light from the second light source 12 to travel above the lower focus Fd in the lower focus plane including the lower focus Fd (image plane) and enter the projection lens 17 because the front edge portion 16*a* of the shade 16 is located in the vicinity of the lower focus Fd. As a result, if, in the conventional vehicular lamp, part of the light form the second light source 12 is blocked by the front edge portion 16*a* of the shade 16 and the lower edge of the light distribution pattern HP for traveling is given a shape along the front edge portion 16*a*, the lower edge is located above the position (horizontal line) of the lens axis La in the projection plane, as illustrated in FIG. 7. Thus in the conventional vehicular lamp, a gap due to the front edge portion 16*a* is formed between the upper end portion of the light distribution pattern LP for passing formed with the light from the first light source 11 and the lower end portion of the light distribution pattern HP for traveling formed with the light from the second light source 12.

In contrast, in the vehicular lamp 10 of Example 1, the lower focus Fd of the lower lens part 31 is set in the vicinity of the front edge portion 16*a* of the shade 16 and the upper focus Fu of the upper lens part 32 is set closer to the projection lens 17 (that is to say, set to be of a shorter focal length DO than the lower focus Fd, on the lens axis La of the projection lens 17. Thus in the vehicular lamp 10, it is possible to partially block the light traveling from the first light source 11 via the first reflector 14 by the shade 16 and cause the light to travel to the lower lens part 31, and to cause the light traveling from the second light source 12 via the second reflector 15 to travel not only below the upper focus Fu but above the upper focus Fu to the upper lens part 32. As a result, in the vehicular lamp 10, the light distribution pattern LP for passing is appropriately formed and the light distribution pattern HP for traveling having the lower end portion overlapping the upper end portion of the light distribution pattern LP for passing is appropriately formed.

In the projection lens 17 of the vehicular lamp 10, the lower focus Fd of the lower lens part 31 located on the lower side and the upper focus Fu of the upper lens part 32 located on the upper side are set on the lens axis La by changing the curvature of the light exit face 17*a* in a cross section extending from the lens axis La in the radial direction. Consequently, in the vehicular lamp 10, the projection lens 17 is made simpler in configuration and smaller as compared with the aforementioned technology in the prior art document (hereinafter simply referred to as prior art), in which an additional projection lens is so provided as to surround a projection lens. As a result, in the vehicular lamp 10, the number of parts is reduced, the cost of molds for lens formation is suppressed, and the manufacturing cost is suppressed as compared with the prior art. In addition, in the vehicular lamp 10, the light from the first light source 11 and the light from the second light source 12 are caused to enter the projection lens 17 via the vicinity of the lower focus Fd and the upper focus Fu on the lens axis La. As a result, in the vehicular lamp 10, it is possible to reduce the space, where optical paths for guiding the light from the first light source 11 and the light from the second light source 12 to the projection lens 17 are to be provided, as compared with the prior art, in which a plurality of focuses are set in various positions. As seen from such facts, the vehicular lamp 10 is able to be downsized with a simple configuration as compared with the prior art.

In the projection lens 17 of the vehicular lamp 10, not only the lower lens part 31 and the upper lens part 32 but the gradual change lens parts 33, each of which continuously changes the focal length Df from the lower focus Fd of the lower lens part 31 to the upper focus Fu of the upper lens part 32, are provided. Consequently, in the vehicular lamp 10, it is possible to produce the light exit face 17*a* of the projection lens 17 as a single, smooth and stepless face and appropriately form the light distribution pattern LP for passing and the light distribution pattern HP for traveling, which partially overlap each other.

Generally, in a projection lens, the lower lens part 31 and the upper lens part 32, which are provided without providing the gradual change lens parts 33, are made different in the curvature of the light exit face 17*a* from each other in order to set different focal lengths Df. As a result, in the light exit face 17*a* of the projection lens, a step is formed in a position of boundary between the lower lens part 31 and the upper lens part 32. Since the position of boundary is on the lens axis La, the step may form an unintended bright region on the periphery of the position of the lens axis La in the projection plane (see a position indicated by a region A enclosed with a broken line in FIG. 4) separately from the light distribution pattern LP for passing. Such a bright region dazzles a person on an oncoming vehicle and is, accordingly, not appropriate to the case of forming the light distribution pattern LP for passing, and makes the light distribution pattern HP for traveling unintended in the case of forming the light distribution pattern HP for traveling.

In contrast, in the projection lens 17 in the vehicular lamp 10 of Example 1, the lower lens part 31 and the upper lens part 32 are joined by the gradual change lens parts 33, each of which changes the focal length Df according to the angular position. As a result, the projection lens 17 of the vehicular lamp 10 has the light exit face 17*a*, which is made stepless and smooth, and has a focus on a lens axis La in any angular position. Thus, each of the gradual change lens parts 33, as bringing about a stepless and smooth face, improves the appearance of the light exit face 17*a* and prevents the irradiation of an unintended position in the projection plane from being caused by a step, and allows the irradiation of an intended position in the projection plane by always having a focus irrespective of the angular position. In the vehicular lamp 10, it is therefore possible to make the light distribution pattern LP for passing and the light distribution pattern HP for traveling appropriate as intended by providing the gradual change lens parts 33 apart from the lower lens part 31 and the upper lens part 32.

In the vehicular lamp 10 of Example 1, the first light source 11 and the second light source 12 are attached to the upper face 13*a* in a flat shape through the board 18 and arranged in one and the same plane. Generally, in a heat sink, heat is radially transferred from a heat source, so that it is possible to improve the cooling performance by securing a section that is increased in volume in the form of a concentric sphere centering at the heat source. In the vehicular lamp 10 of Example 1, the upper face 13*a* of the heat radiating member 13 is made flat, so that a section in the form of a concentric sphere with a large volume is easily secured below each of the first light source 11 and the second light source 12 as compared with the case where a step is provided on the upper face 13*a*, without any partial breakage due to the step. Thus in the vehicular lamp 10, a volume for heat transfer is secured in the heat radiating member 13 with respect to each of the first light source 11 and the second light source 12 so as to appropriately cool the first light source 11 and the second light source 12. In addition, in the vehicular lamp 10, the first light source 11 and the second light source 12 are attached to the upper face 13*a* in a flat shape, so that it is possible to provide both the light sources 11 and 12 on one and the same board 18 and reduce the cost of parts and the assembly cost.

In the vehicular lamp 10 of Example 1, the changeover from the light distribution for passing (low beams) to the light distribution for traveling (high beams) and vice versa is allowed by providing the first light source 11, the second light source 12, the first reflector 14, the second reflector 15, the shade 16, and the projection lens 17 in the positional relationship as described above. In a known vehicular lamp as the conventional vehicular lamp, a shade is so provided as to be displaceable from a position to block part of light forming a light distribution pattern to a position not to block the light and vice versa, and the changeover from the light distribution for passing to the light distribution for traveling and vice versa is allowed by displacing the shade with a driving part. The driving part for displacing the shade in such conventional vehicular lamp is a complicated, relatively expensive part, which causes the increase in number of parts and number of assembly processes, and the rise of the total cost. In contrast, in the vehicular lamp 10 of Example 1, the first light source 11, the second light source 12, the first reflector 14, the second reflector 15, the shade 16, and the projection lens 17 are only provided in the positional relationship as described above, so that the number of parts and the number of assembly processes are each reduced and the total cost is lowered as compared with the conventional vehicular lamp.

The vehicular lamp 10 of Example 1 has the following operational effects.

The vehicular lamp 10 includes the projection lens 17, which projects the light emitted from the first light source 11, so as to form the light distribution pattern LP for passing and projects the light emitted from the second light source 12, so as to form the light distribution pattern HP for traveling. In the projection lens 17 of the vehicular lamp 10, the lower lens part 31 having the lower focus Fd on the lens axis La and the upper lens part 32 having the upper focus Fu on the lens axis La, with the upper focus Fu being shorter in the focal length Df than the lower focus Fd, are set on the lower and upper sides of the lens axis La as a center, respectively. As a result, the vehicular lamp 10 is able to form the light distribution pattern LP for passing and the light distribution pattern HP for traveling so that the lower end portion of the light distribution pattern HP for traveling may overlap the upper end portion of the light distribution pattern LP for passing, and to be downsized with a simple configuration as compared with the prior art.

In the projection lens 17 of the vehicular lamp 10, the gradual change lens parts 33, each of which joins the lower lens part 31 and the upper lens part 32 and continuously changes the focal length Df from the lower focus Fd to the upper focus Fu, are set. As a result, the vehicular lamp 10 has the light exit face 17*a* of the projection lens 17, which is produced as a single, smooth and stepless face, and appropriately forms the light distribution pattern LP for passing and the light distribution pattern HP for traveling, which partially overlap each other.

In the vehicular lamp 10, the projection lens 17 is plane-symmetrically formed with respect to the vertical plane including the lens axis La and the gradual change lens parts 33 are so provided as to make a pair in the width direction. Thus, the projection lens 17 of the vehicular lamp 10 has a simple configuration, which makes the projection lens 17 easy to manufacture or assemble.

In the vehicular lamp 10, the curvature of the light exit face 17*a* in the radial direction from the lens axis La is set to be larger in the upper lens part 32 than in the lower lens part 31. Thus in the vehicular lamp 10, the lower lens part 31 and the upper lens part 32 are set in the projection lens 17 by simply changing the curvature of the light exit face 17*a*, leading to a simple configuration. In the vehicular lamp 10, the lower lens part 31 and the upper lens part 32 are set by setting the curvature of the light exit face 17*a*, so that it is possible to set the lower focus Fd and the upper focus Fu on the lens axis La while achieving a simple configuration. In addition, in the vehicular lamp 10, the gradual change lens parts 33 are each set by setting the curvature of the light exit face 17*a*, so that it is possible to produce the light exit face 17*a* as a single, smooth and stepless face while achieving a simple configuration.

In the vehicular lamp 10, the light emitted from the first light source 11 is caused to pass through the lower focus Fd from above the lens axis La and enter the lower lens part 31, and the light emitted from the second light source 12 is caused to pass through the upper focus Fu from below the lens axis La and enter the upper lens part 32. Thus, the vehicular lamp 10 allows, with a simple configuration, the light distribution pattern LP for passing to be formed with the light from the first light source 11, and the light distribution pattern HP for traveling to be formed with the light from the second light source 12, so that the two patterns may partially overlap each other.

The vehicular lamp 10 includes the first reflector 14, which reflects the light emitted from the first light source 11 to the lower focus Fd, and the second reflector 15, which reflects the light emitted from the second light source 12 to the upper focus Fu. In the vehicular lamp 10, the first light source 11 and the second light source 12 are provided in one and the same plane below the lens axis La, and the second reflector 15 is provided below the lens axis La and ahead of the first light source 11 in the optical axis direction inside the first reflective face 21. Consequently, in the vehicular lamp 10, the light as emitted from the first light source 11 and reflected by the first reflector 14 and the light as emitted from the second light source 12 and reflected by the second reflector 15 are both allowed to enter the projection lens 17 even though the first light source 11 and the second light source 12 are provided in one and the same plane. In the vehicular lamp 10, therefore, the mounting place (the upper face 13*a* of the heat radiating member 13 in Example 1), where the first light source 11 and the second light source 12 are mounted, is made simple in shape and the first light source 11 and the second light source 12 are provided on one and the same board 18, which results in a simple configuration.

Thus, the vehicular lamp 10 of Example 1 as the vehicular lamp according to the present disclosure forms the light distribution pattern HP for traveling, which has the lower end portion overlapping the upper end portion of the light distribution pattern LP for passing, and is downsized with a simple configuration.

Example 2

Figure 8:
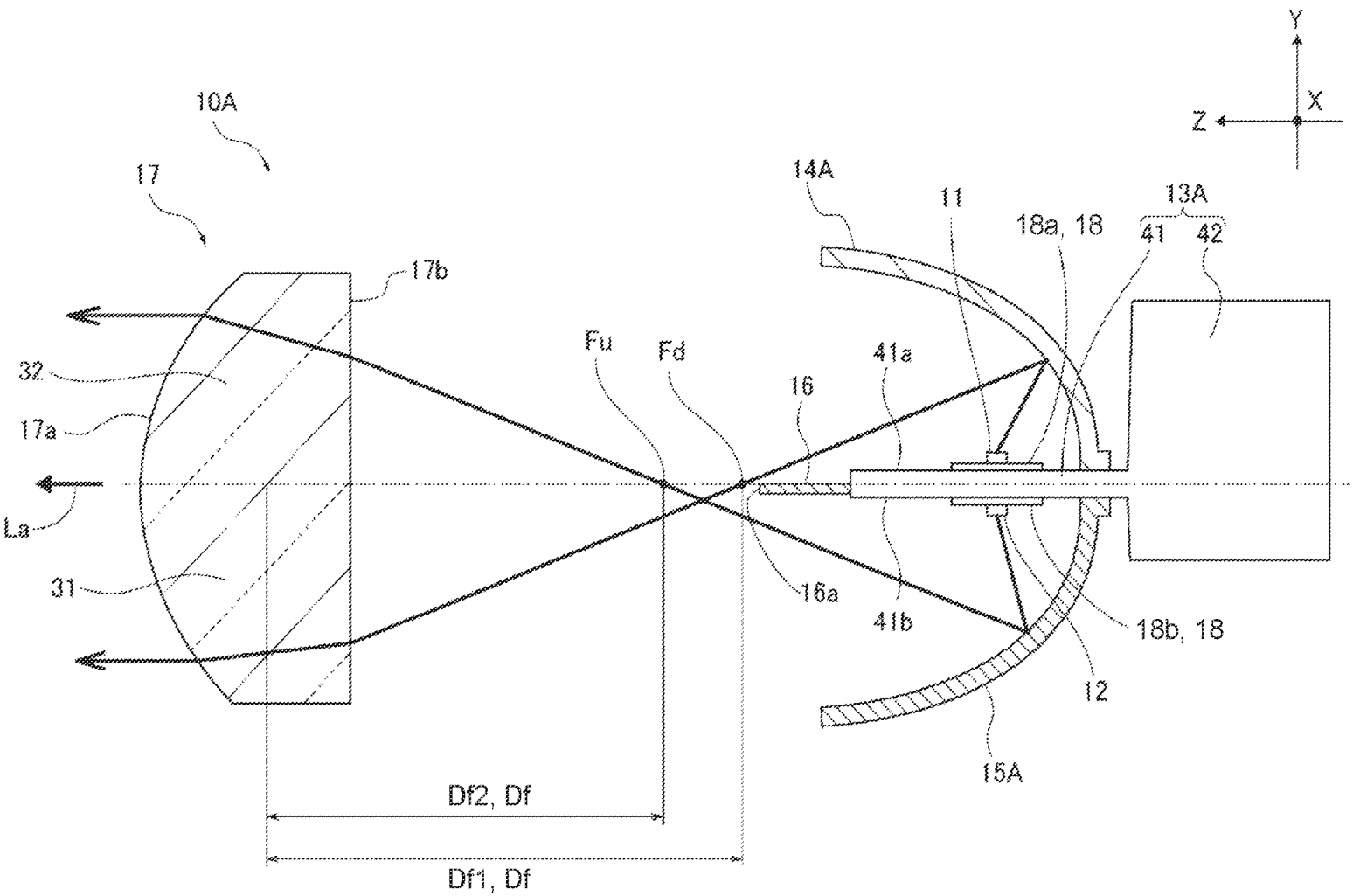
FIG. 8 is a diagram illustrating a vehicular lamp of Example 2.

Next, a vehicular lamp 10A of Example 2 as an embodiment of the present disclosure is described using FIG. 8. The vehicular lamp 10A is obtained by changing the mode of setting of the first light source 11 and the second light source 12 in the vehicular lamp 10 of Example 1. The vehicular lamp 10A is the same in basic idea and configuration as the vehicular lamp 10 of Example 1, so that the same reference sign is imparted to a component or part having like configuration and detailed description on such component or part is omitted.

In the vehicular lamp 10A of Example 2, the first light source 11 and the second light source 12 are provided on a heat radiating member 13A. The heat radiating member 13A includes a mount piece 41 and a heat radiating part 42. The mount piece 41 is a place where the first light source 11 and the second light source 12 are mounted, and is in the form of a flat plate that is orthogonal to the vertical direction and includes the lens axis La. On an upper face 41*a* on the upper side in the vertical direction of the mount piece 41, the first light source 11 is mounted through a board 18*a*, and the second light source 12 is mounted on a lower face 41*b* on the lower side in the vertical direction through a board 18*b*.

The heat radiating part 42 cools the first light source 11 and the second light source 12. The heat radiating part 42 is formed continuously from an end portion on the back side in the optical axis direction of the mount piece 41, extends in the vertical direction and the width direction with respect to the mount piece 41, and is appropriately provided with a plurality of heat radiating fins. The heat radiating part 42 releases the heat outside, which is generated in the first light source 11 and the second light source 12 and transferred to the heat radiating part 42 through the mount piece 41.

Accompanying the change in mode of setting of the first light source 11 and the second light source 12, in the vehicular lamp 10A, a first reflector 14A is so provided on the upper face 41*a* as to cover the first light source 11 and a second reflector 15A is so provided on the lower face 41*b* as to cover the second light source 12. Thus, the mount piece 41 of the heat radiating member 13A serves as the parallel mounting part, which is provided on the lens axis La and along the lens axis La, on the upper side of which the first light source 11 and the first reflector 14A are provided, and on the lower side of which the second light source 12 and the second reflector 15A are provided. The first reflector 14A and the second reflector 15A are the same in configuration as the first reflector 14 and the second reflector 15 in Example 1 except that the positional relationship of setting is changed, and have the same positional relationship to the respective light sources (11 and 12) and the two focuses (the lower focus Fd and the upper focus Fu) as that in Example 1.

In the vehicular lamp 10A, accompanying the fact that the mount piece 41 is provided on the lens axis La as described above, the shade 16 is provided at a front end of the mount piece 41. As a result, in the vehicular lamp 10A, the shade 16 cooperates with the mount piece 41 to block light at the horizontal plane including the lens axis La on the back side in the optical axis direction of the lower focus Fd.

In the vehicular lamp 10A, the light from the first light source 11 as turned on is reflected by the first reflective face 21 of the first reflector 14A so as to cause the light to travel to the lower lens part 31 via the vicinity of the lower focus Fd of the lower lens part 31. Thus in the vehicular lamp 10A, the light distribution pattern LP for passing is formed by guiding the light from the first light source 11 above the mount piece 41 to the lower focus Fd so as to cause the light to enter the lower lens part 31.

In addition, in the vehicular lamp 10A, the light from the second light source 12 as turned on is reflected by the second reflective face 22 of the second reflector 15A so as to cause the light to travel to the upper lens part 32 via the vicinity of the upper focus Fu of the upper lens part 32. Thus in the vehicular lamp 10A, the light distribution pattern HP for traveling is formed by guiding the light from the second light source 12 below the mount piece 41 to the upper focus Fu so as to cause the light to enter the upper lens part 32.

The vehicular lamp 10A of Example 2 has the following operational effects. The vehicular lamp 10A is basically the same in configuration as the vehicular lamp 10 of Example 1 and, accordingly, has the same effects as Example 1.

In addition, in the vehicular lamp 10A, an optical path for guiding the light from the first light source 11 to the lower focus Fd and an optical path for guiding the light from the second light source 12 to the upper focus Fu are vertically separated from each other by the mount piece 41.

Consequently, in the vehicular lamp 10A, the second reflector 15A is not arranged between the first light source 11 and the first reflector 14A on one hand and the lower focus Fd on the other, unlike the case of the vehicular lamp 10 of Example 1, so that an optical path guiding from the first light source 11 to the lower focus Fd via the first reflector 14A is improved in flexibility as compared with the vehicular lamp 10.

Thus, the vehicular lamp 10A of Example 2 as the vehicular lamp according to the present disclosure forms the light distribution pattern HP for traveling, which has the lower end portion overlapping the upper end portion of the light distribution pattern LP for passing, and is downsized with a simple configuration.

Example 3

Figure 9:
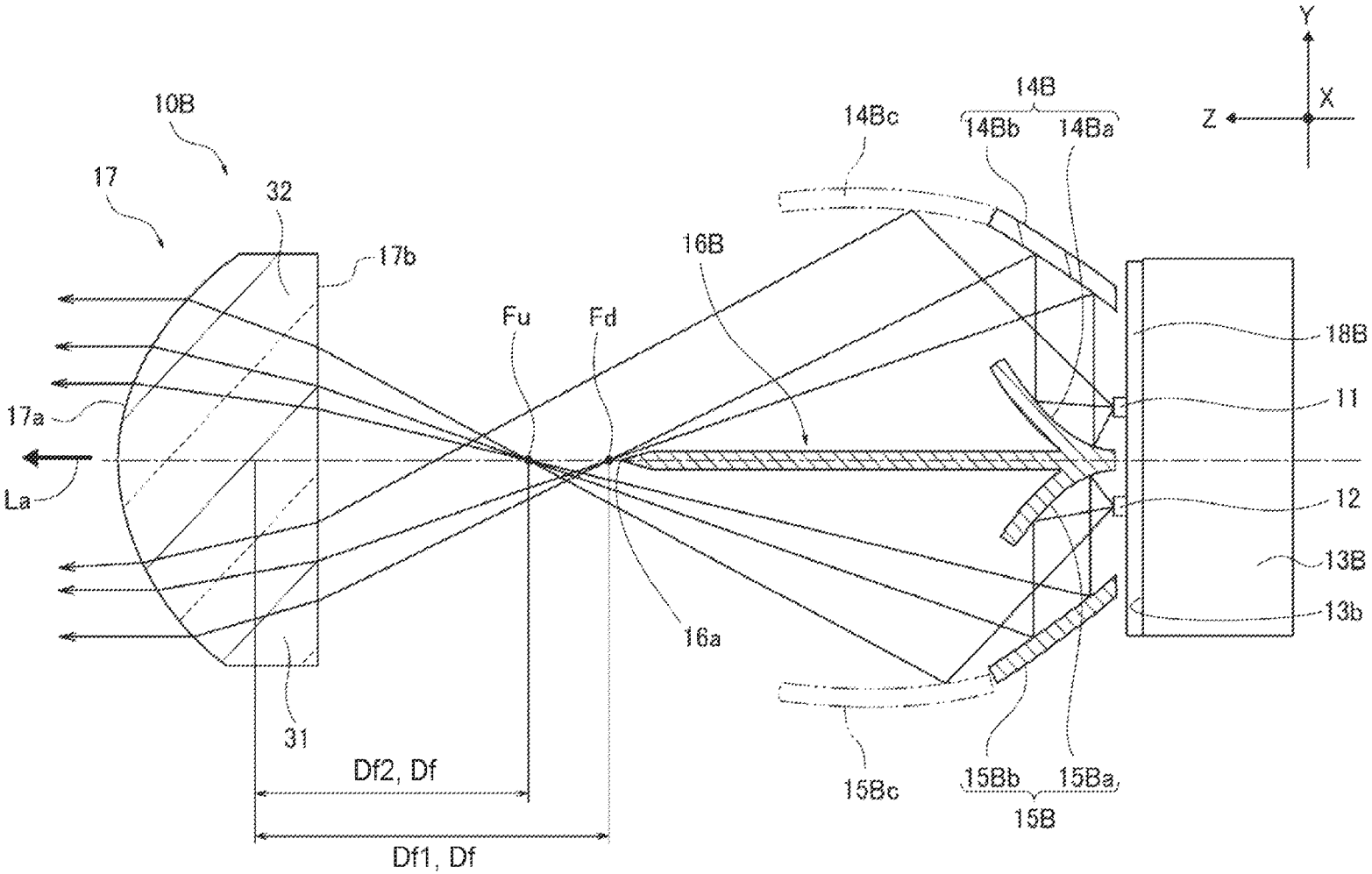
FIG. 9 is a diagram illustrating a vehicular lamp of Example 3.

Next, a vehicular lamp 10B of Example 3 as an embodiment of the present disclosure is described using FIG. 9. The vehicular lamp 10B is obtained by changing the mode of setting of the first light source 11 and the second light source 12 in the vehicular lamp 10 of Example 1. The vehicular lamp 10B is the same in basic idea and configuration as the vehicular lamp 10 of Example 1, so that the same reference sign is imparted to a component or part having like configuration and detailed description on such component or part is omitted.

In the vehicular lamp 10B of Example 3, the first light source 11 and the second light source 12 are mounted on a heat radiating member 13B. The heat radiating member 13B has an orthogonal mounting face 13*b* orthogonal to the optical axis direction, and is so formed as to appropriately include heat radiating fins or the like provided on the back side in the optical axis direction of the orthogonal mounting face 13*b*. The orthogonal mounting face 13*b* is a place where the first light source 11 and the second light source 12 are mounted, and extends in the vertical direction and the width direction around the lens axis La as a center. On the orthogonal mounting face 13*b*, a board 18B is so provided as to cross over the lens axis La in the vertical direction and the width direction. On the board 18B, the first light source 11 is implemented above the lens axis La and the second light source 12 is implemented below the lens axis La. The first light source 11 and the second light source 12 each have an optical axis of light emission (optical axis direction) substantially coincident with the optical axis direction. Thus, the heat radiating member 13B serves as the orthogonal mounting part, which extends orthogonally to the lens axis La, and on which the first light source 11 is provided above the lens axis La and the second light source 12 is provided below the lens axis La.

Accompanying the above, in the vehicular lamp 10B, a first reflector 14B includes a first reflecting part 14Ba and a second reflecting part 14Bb. The first reflecting part 14Ba is provided ahead of the first light source 11 in the optical axis direction and reflects the light emitted from the first light source 11 toward the second reflecting part 14Bb. The first reflecting part 14Ba in Example 3 is assumed as a paraboloid having a focus at the first light source 11, as an example, and reflects the light emitted from the first light source 11 toward the second reflecting part 14Bb as a nearly parallel light.

The second reflecting part 14Bb is provided above the first reflecting part 14Ba in the vertical direction, and reflects the light reflected by the first reflecting part 14Ba so that the light may enter the lower lens part 31 via the lower focus Fd of the lower lens part 31 of the projection lens 17. The second reflecting part 14Bb in Example 3 is assumed as a curved face making the first light source 11 and the vicinity of the lower focus Fd conjugate via the first reflecting part 14Ba, namely, a paraboloid having a focus in the vicinity of the lower focus Fd, as an example. Therefore, the second reflecting part 14Bb causes the light from the first light source 11 as reflected by the first reflecting part 14Ba to travel into the vicinity of the lower focus Fd.

In the vehicular lamp 10B, a second reflector 15B includes a first reflecting part 15Ba and a second reflecting part 15Bb. The first reflecting part 15Ba is provided ahead of the second light source 12 in the optical axis direction and reflects the light emitted from the second light source 12 toward the second reflecting part 15Bb. The first reflecting part 15Ba in Example 3 is assumed as a paraboloid having a focus at the second light source 12, as an example, and reflects the light emitted from the second light source 12 toward the second reflecting part 15Bb as a nearly parallel light.

The second reflecting part 15Bb is provided below the first reflecting part 15Ba in the vertical direction, and reflects the light reflected by the first reflecting part 15Ba so that the light may enter the upper lens part 32 via the upper focus Fu of the upper lens part 32 of the projection lens 17. The second reflecting part 15Bb in Example 3 is assumed as a curved face making the second light source 12 and the vicinity of the upper focus Fu conjugate via the first reflecting part 15Ba, namely, a paraboloid having a focus in the vicinity of the upper focus Fu, as an example. Therefore, the second reflecting part 15Bb causes the light from the second light source 12 as reflected by the first reflecting part 15Ba to travel into the vicinity of the upper focus Fu.

The first reflecting part 14Ba of the first reflector 14B and the first reflecting part 15Ba of the second reflector 15B are provided integrally with a shade 16B. The shade 16B extends backward in the optical axis direction to the vicinity of the orthogonal mounting face 13*b*, and the first reflecting part 14Ba and the first reflecting part 15Ba are provided in a back end portion of the shade 16B. The shade 16B is supported, at both ends in the width direction, by a frame member giving an external shape to the vehicular lamp 10B and extends in the optical axis direction on the lens axis La, and the front edge portion 16*a* is located in the vicinity of the lower focus Fd. The second reflecting part 14Bb of the first reflector 14B and the second reflecting part 15Bb of the second reflector 15B are each supported by the frame member at both ends in the width direction.

In the vehicular lamp 10B, the light from the first light source 11 as turned on is reflected by the first reflecting part 14Ba of the first reflector 14B so as to cause the light to travel to the second reflecting part 14Bb. The light is reflected by the second reflecting part 14Bb, then travels to the lower lens part 31 via the vicinity of the lower focus Fd of the lower lens part 31 and forms the light distribution pattern LP for passing. Thus in the vehicular lamp 10B, the light from the first light source 11 is guided above the shade 16B to the lower focus Fd so as to cause the light to enter the lower lens part 31.

In addition, in the vehicular lamp 10B, the light from the second light source 12 as turned on is reflected by the first reflecting part 15Ba of the second reflector 15B so as to cause the light to travel to the second reflecting part 15Bb. The light is reflected by the second reflecting part 15Bb, then travels to the upper lens part 32 via the vicinity of the upper focus Fu of the upper lens part 32 and forms the light distribution pattern HP for traveling. Thus in the vehicular lamp 10B, the light from the second light source 12 is guided below the shade 16B to the upper focus Fu so as to cause the light to enter the upper lens part 32.

The vehicular lamp 10B of Example 3 has the following operational effects. The vehicular lamp 10B is basically the same in configuration as the vehicular lamp 10 of Example 1 and, accordingly, has the same effects as Example 1.

In addition, in the vehicular lamp 10B, an optical path for guiding the light from the first light source 11 to the lower focus Fd and an optical path for guiding the light from the second light source 12 to the upper focus Fu are vertically separated from each other by the shade 16B. Consequently, in the vehicular lamp 10B, the second reflector 15B is not arranged between the first reflector 14B and the lower focus Fd, unlike the case of the vehicular lamp 10 of Example 1, so that an optical path guiding from the first light source 11 to the lower focus Fd is improved in flexibility as compared with the vehicular lamp 10. In the vehicular lamp 10B, the first light source 11 and the second light source 12 are provided on the orthogonal mounting face 13*b* of the heat radiating member 13B through the single board 18B, unlike the case of the vehicular lamp 10A of Example 2, so that assembly processes are made simple on the whole as compared with the vehicular lamp 10A.

Thus, the vehicular lamp 10B of Example 3 as the vehicular lamp according to the present disclosure forms the light distribution pattern HP for traveling, which has the lower end portion overlapping the upper end portion of the light distribution pattern LP for passing, and is downsized with a simple configuration.

In Example 3, the first reflector 14B includes the first reflecting part 14Ba and the second reflecting part 14Bb, and the second reflector 15B includes the first reflecting part 15Ba and the second reflecting part 15Bb. The first and second reflectors 14B and 15B, however, are not limited to the configuration in Example 3, and it is also possible to provide the first reflector 14B, to which a third reflecting part 14Bc is added, and the second reflector 15B, to which a third reflecting part 15Bc is added, as illustrated in FIG. 9 with a long-dashed double-dotted line.

The third reflecting part 14Bc reflects the light, which is emitted from the first light source 11 and travels toward the front side of the second reflecting part 14Bb without reaching the first reflecting part 14Ba, toward the lower lens part 31 and is provided ahead of the second reflecting part 14Bb. The third reflecting part 14Bc may be assumed as a free-form surface based on an ellipse having a first focus at the first light source 11 and a second focus in the vicinity of the lower focus Fd or may be of any other configuration. In the example illustrated in FIG. 9, the third reflecting part 14Bc is assumed as a free-form surface based on an ellipse and reflects the light from the first light source 11 so as to cause the light to travel to the lower lens part 31 without passing through the lower focus Fd, with at least part of the light distribution pattern LP for passing being formed with such light. The third reflecting part 14Bc is not limited to the configuration in Example 3 but may reflect the light from the first light source 11 so as to cause the light to pass through the lower focus Fd.

The third reflecting part 15Bc reflects the light, which is emitted from the second light source 12 and travels toward the front side of the second reflecting part 15Bb without reaching the first reflecting part 15Ba, toward the upper lens part 32 and is provided ahead of the second reflecting part 15Bb. The third reflecting part 15Bc may be assumed as a free-form surface based on an ellipse having a first focus at the second light source 12 and a second focus in the vicinity of the upper focus Fu or may be of any other configuration. In the example illustrated in FIG. 9, the third reflecting part 15Bc is of the configuration as above and reflects the light from the second light source 12 so as to cause the light to pass through the upper focus Fu and then travel to the upper lens part 32, with at least part of the light distribution pattern HP for traveling being formed with such light. The third reflecting part 15Bc is not limited to the configuration in Example 3 but may reflect the light from the second light source 12 so as to cause the light not to pass through the upper focus Fu. If the third reflecting part 14Bc and the third reflecting part 15Bc are provided as described above, the light from the first light source 11 and the light from the second light source 12 are used more effectively to form the light distribution pattern LP for passing and the light distribution pattern HP for traveling.

Figure 10:
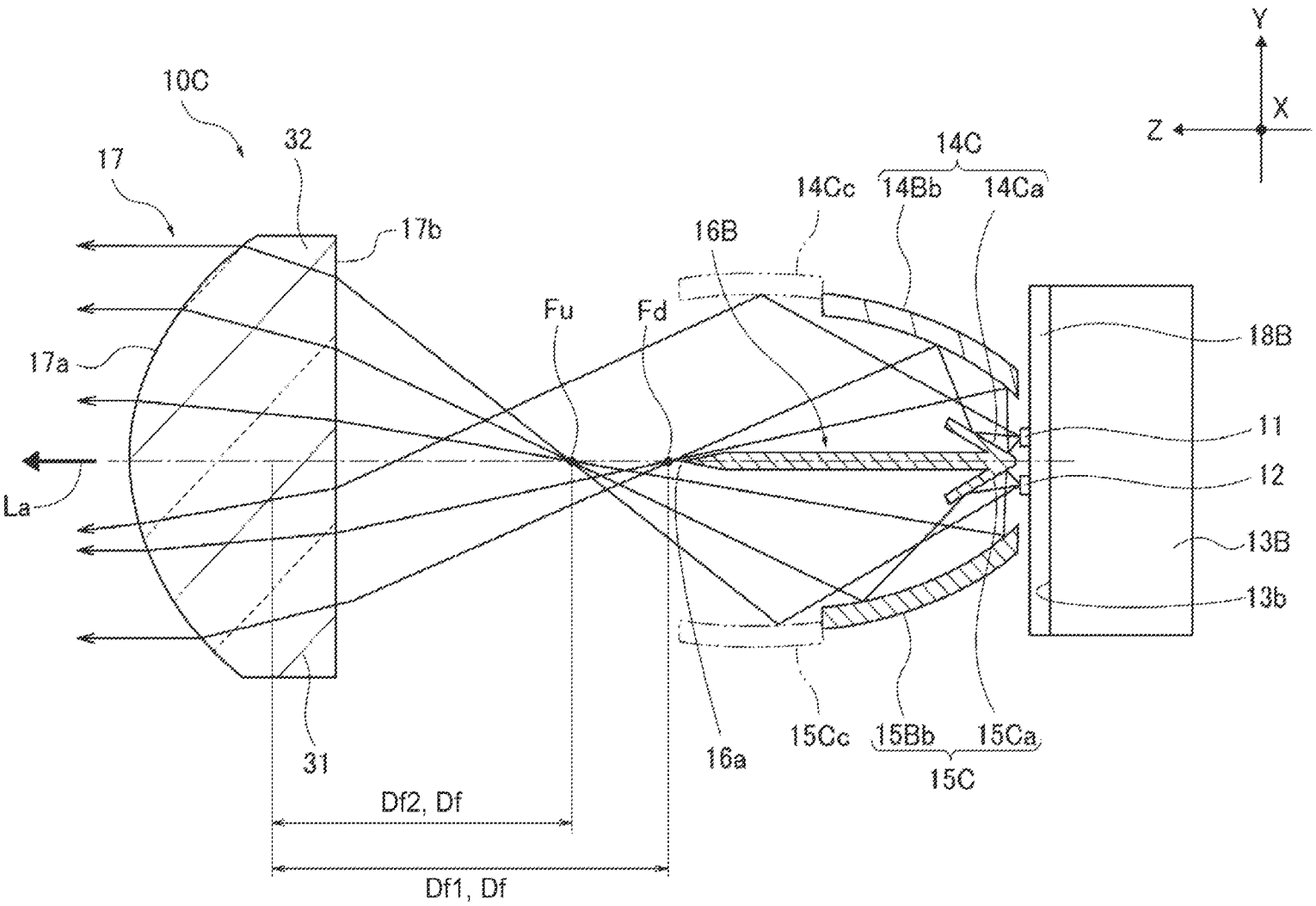
FIG. 10 is a diagram illustrating a vehicular lamp as a modification of Examples 1 through 3.

In Example 3, the first reflecting part 14Ba and the second reflecting part 14Bb of the first reflector 14B and the first reflecting part 15Ba and the second reflecting part 15Bb of the second reflector 15B are each assumed as a free-form surface. The first and second reflectors 14B and 15B, however, are not limited to the configuration in Example 3 as long as the first reflector 14B causes the light from the first light source 11 to travel to the lower lens part 31 and form the light distribution pattern LP for passing and the second reflector 15B causes the light from the second light source 12 to travel to the upper lens part 32 and form the light distribution pattern HP for traveling. In FIG. 10, a vehicular lamp 10C including exemplary reflectors is illustrated. In the vehicular lamp 10C, a first reflecting part 14Ca of a first reflector 14C and a first reflecting part 15Ca of a second reflector 15C are each assumed as a flat face and, accompanying that, the second reflecting part 14Bb and the second reflecting part 15Bb are changed in degree of curviness (focal position). The vehicular lamp 10C is the same in configuration as the vehicular lamp 10B of Example 3 except for the above and, accordingly, has the same effects as the vehicular lamp 10B. In the vehicular lamp 10C, similarly to the case illustrated in FIG. 9 with a long-dashed double-dotted line, a third reflecting part 14Cc and a third reflecting part 15Cc may be provided and, in that case, the light from the first light source 11 and the light from the second light source 12 are used more effectively to form the light distribution pattern LP for passing and the light distribution pattern HP for traveling.

The vehicular lamp of the present disclosure has been described above based on the respective examples, to which a specific configuration is not limited, and any design modification, addition, and the like are allowable as long as they do not depart from the gist of the invention according to the Claims.

The configurations of the respective examples are as described above. The configurations of the respective examples, however, are not limitative, and another configuration may be employed as long as the projection lens 17 forms the light distribution pattern LP for passing with the light from the first light source 11 and the light distribution pattern HP for traveling with the light from the second light source 12, and includes the lower lens part 31 having the lower focus Fd set on the lens axis La and the upper lens part 32 having the upper focus Fu set on the lens axis La, with the upper focus Fu being shorter in the focal length Df than the lower focus Fd. In other words, the positional relationship among the first light source 11, the second light source 12, the first reflector 14, and the second reflector 15 is not limited to the positional relationships in the respective examples but may be set as appropriate.

In the respective examples, the lower lens part 31, the upper lens part 32, and the gradual change lens parts 33 are set in the projection lens 17. The configurations of the respective examples, however, are not limitative, and the gradual change lens parts 33 may not be set as long as the lower lens part 31 and the upper lens part 32 are set.

In the respective examples, the light entrance face 17*b* of the projection lens 17 is a flat face, so that the lower lens part 31, the upper lens part 32, and the gradual change lens parts 33 (their respective focal lengths Df) are set by changing the curvature of the light exit face 17*a*. The projection lens 17, however, is not limited to the configuration in the respective examples, and the light exit face 17*a* and the light entrance face 17*b* may be changed in curvature or the light entrance face 17*b* may only be changed in curvature as long as the lower lens part 31 and the upper lens part 32 (along with the gradual change lens parts 33 as appropriate) are set. In such cases, the curvatures of the light exit face 17*a* and the light entrance face 17*b* are, or only the curvature of the light entrance face 17*b* is, so set as to be larger in the upper lens part 32 than in the lower lens part 31.

DESCRIPTION OF REFERENCE NUMERALS

10, 10A, 10B, 10C vehicular lamp
11 first light source
12 second light source
13B heat radiating member (as an example of the orthogonal mounting part)
14, 14A, 14B, 14C first reflector
15, 15A, 15B, 15C second reflector
17 projection lens
17*a* light exit face
17*b* light entrance face
31 lower lens part
32 upper lens part
33 gradual change lens part
41 mount piece (as an example of the parallel mounting part)
Df focal length
Fd lower focus
Fu upper focus
HP light distribution pattern for traveling
La lens axis
LP light distribution pattern for passing

The invention claimed is:

1. A vehicular lamp comprising a projection lens projecting light emitted from a first light source to form a light distribution pattern for passing, and projecting light emitted from a second light source to form a light distribution pattern for traveling, wherein a lower lens part and an upper lens part are set in the projection lens about a lens axis as a center, wherein a lower focus is set on the lens axis in the lower lens part, wherein an upper focus shorter in focal length than the lower focus is set on the lens axis in the upper lens part, wherein a gradual change lens part joining the lower lens part and the upper lens part is set in the projection lens, and wherein the gradual change lens part continuously changes a focal length from the lower focus to the upper focus.

2. The vehicular lamp according to claim 1, wherein the projection lens is plane-symmetrically formed with respect to a vertical plane including the lens axis and the gradual change lens part is provided as a pair in a width direction orthogonal to the vertical plane.

3. The vehicular lamp according to claim 1, wherein the upper lens part is set to be larger in curvature of a light exit face or a light entrance face in a radial direction from the lens axis than the lower lens part.

4. The vehicular lamp according to claim 1, wherein the light emitted from the first light source passes through the lower focus from above the lens axis and enters the lower lens part, and wherein the light emitted from the second light source passes through the upper focus from below the lens axis and enters the upper lens part.

5. The vehicular lamp according to claim 1, further comprising a first reflector reflecting the light emitted from the first light source to the lower focus and a second reflector reflecting the light emitted from the second light source to the upper focus, wherein the first light source and the second light source are provided in an identical plane below the lens axis, and wherein the second reflector is provided below the lens axis and closer to the projection lens than the first light source.

6. The vehicular lamp according to claim 1, further comprising a first reflector reflecting the light emitted from the first light source to the lower focus and a second reflector reflecting the light emitted from the second light source to the upper focus, wherein the first light source and the first reflector are provided on an upper side of a parallel mounting part provided on the lens axis and along the lens axis, and wherein the second light source and the second reflector are provided on a lower side of the parallel mounting part.

7. The vehicular lamp according to claim 1, further comprising a first reflector reflecting the light emitted from the first light source to the lower focus and a second reflector reflecting the light emitted from the second light source to the upper focus, wherein the first light source is provided above the lens axis on an orthogonal mounting part extending orthogonally to the lens axis, wherein the second light source is provided below the lens axis on the orthogonal mounting part, wherein the first reflector is provided above the lens axis, and wherein the second reflector is provided below the lens axis.

* * * * *